US009217970B2

(12) United States Patent
Fudo et al.

(10) Patent No.: US 9,217,970 B2
(45) Date of Patent: Dec. 22, 2015

(54) HEATER FOR FIXING DEVICE

(71) Applicant: ALPS ELECTRIC CO., LTD., Tokyo (JP)

(72) Inventors: Heishiro Fudo, Miyagi-ken (JP); Tomoko Wauke, Miyagi-ken (JP); Eihin Setsu, Miyagi-ken (JP); Hirotoshi Terao, Miyagi-ken (JP); Kazuma Kobashi, Miyagi-ken (JP); Eiji Okada, Miyagi-ken (JP); Susumu Nakajima, Miyagi-ken (JP); Mikio Onodera, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 85 days.

(21) Appl. No.: 14/279,664

(22) Filed: May 16, 2014

(65) Prior Publication Data

US 2014/0353303 A1 Dec. 4, 2014

(30) Foreign Application Priority Data

Jun. 3, 2013 (JP) ..... 2013-116633

(51) Int. Cl.
*H05B 1/02* (2006.01)
*G03G 15/20* (2006.01)

(52) U.S. Cl.
CPC ..... *G03G 15/2057* (2013.01); *G03G 15/2053* (2013.01)

(58) Field of Classification Search
CPC . G03G 15/2057; G03G 15/2053; H05B 1/02; H05B 3/12; H05B 3/14
USPC ..... 219/553, 494, 480, 481
See application file for complete search history.

(56) References Cited

U.S. PATENT DOCUMENTS 6,438,497 B1 * 8/2002 Mansky ..... B01J 19/0046 422/68.1
8,747,701 B2 * 6/2014 Takeyama ..... G03G 15/0233 252/500
2005/0007136 A1 * 1/2005 Feder ..... H01L 21/67248 324/750.05

FOREIGN PATENT DOCUMENTS

JP 2005-71843 3/2005

* cited by examiner

*Primary Examiner* — Mark Paschall
(74) *Attorney, Agent, or Firm* — Beyer Law Group LLP

(57) ABSTRACT

A heater for fixing devices includes a glass substrate, a heating element, electrode patterns connected to the heating element, a first protective layer, and a second protective layer. The glass substrate is made of an alkali-free glass. The first protective layer is formed by firing a mixture of a first glass powder and a first filler. The first glass powder contains no alkali metal oxide and has a lower softening point than the glass substrate. The first filler has a lower thermal expansion coefficient than the alkali-free glass for the glass substrate. The second protective layer is made of a material that does not contain the first filler contained in the first protective layer.

15 Claims, 2 Drawing Sheets

HEATER FOR FIXING DEVICE

CLAIM OF PRIORITY

This application claims benefit of Japanese Patent Application No. 2013-116633 filed on Jun. 3, 2013, which is hereby incorporated by reference.

BACKGROUND OF THE INVENTION

1. Field of the Invention

The present invention relates to heaters for heat fixing devices that fix toner to sheets by heating.

2. Description of the Related Art

Japanese Unexamined Patent Application Publication No. 2005-71843 discloses a plate heater including a substrate, a heating element disposed on the substrate, and an overcoat glass layer (protective film) disposed over the heating element.

The substrate disclosed in the above literature is a glass substrate formed from a glass material containing $SiO_2$, $Al_2O_3$, and $Li_2O$. The overcoat glass layer is formed from a glass material containing a low-melting-point glass and a low-expansion filler. A Teflon® coating is formed over the overcoat glass layer.

Unfortunately, the heater disclosed in the above literature has a problem in that alkali metals contained in the glass materials may migrate between electrode patterns connected to the heating element, depending on the arrangement of the electrode patterns.

Another problem with the heater disclosed in the above literature is that the heater may warp because it does not take into account the difference in thermal expansion coefficient between the substrate and the protective film (overcoat glass layer).

A further problem with the heater disclosed in the above literature is that the low-expansion filler contained in the overcoat glass layer decreases the surface smoothness (i.e., increases the surface roughness) of the overcoat glass layer. If a heating belt comes into contact with such an overcoat glass layer, the heating belt may be damaged by large irregularities in the surface of the overcoat glass layer.

SUMMARY OF THE INVENTION

The present invention provides a heater for fixing devices that suffers from less migration and warpage and has a higher surface smoothness than heaters in the related art.

A heater for a fixing device according to a first aspect of the present invention includes a glass substrate; a heating element disposed on the glass substrate; a plurality of electrode patterns disposed on the glass substrate and connected to the heating element; a first protective layer disposed on the heating element and the electrode patterns; and a second protective layer disposed on the first protective layer. The glass substrate is made of an alkali-free glass containing no alkali metal oxide. The first protective layer is formed by firing a mixture of a first glass powder and a first filler. The first glass powder contains no alkali metal oxide and contains a material that reduces the softening point of the first protective layer below the softening point of the glass substrate. The first filler has a lower thermal expansion coefficient than the alkali-free glass for the glass substrate. The second protective layer is made of a material that does not contain the first filler contained in the first protective layer.

According to the first aspect, neither of the glass substrate and the first protective layer, which are in contact with the electrode patterns, contains an alkali metal oxide. Thus, the heater according to the first aspect suffers from less migration than heaters in the related art.

Whereas the first glass powder contained in the first protective layer is selected to have a lower softening point than the glass substrate so that it can be fired on the glass substrate, there has been no glass powder having a low thermal expansion coefficient (i.e., a thermal expansion coefficient close to that of the glass substrate). The first protective layer, however, further contains the first filler, which has a low thermal expansion coefficient and thus allows the thermal expansion coefficient of the first protective layer to be closer to that of the glass substrate. This results in less warpage.

The first protective layer tends to have large surface irregularities because it contains the first filler. The first protective layer, however, is covered with the second protective layer, which does not contain the first filler contained in the first protective layer and thus has high surface smoothness.

In the first aspect, the second protective layer is preferably formed by firing a second glass powder without adding the first filler. The second glass powder may contain a material that reduces the softening point of the second protective layer below the softening point of the glass substrate. For example, a Teflon® coating on an overcoat glass layer, as disclosed in the cited literature, exhibits insufficient heat resistance if the heating element heats up to about 300° C. In the first aspect, the use of glass for the second protective layer improves the heat resistance of the second protective layer.

In the first aspect, the second protective layer may contain an alkali metal oxide. This allows for a reduction in thermal expansion coefficient. The alkali metal oxide contained in the second protective layer does not cause the problem of migration because the first protective layer is disposed between the electrode patterns and the second protective layer.

In the first aspect, the second protective layer may contain a second filler (e.g., eucryptite) that contains an alkali metal oxide, that has a lower thermal expansion coefficient than the second glass powder, and that softens at a surface thereof below the softening point of the glass substrate. A filler containing an alkali metal oxide, such as eucryptite, melts slightly at the surface thereof during firing and thus does not decrease the surface smoothness.

In the first aspect, the first glass powder contained in the first protective layer may be the same as the second glass powder contained in the second protective layer. This allows the first protective layer and the second protective layer to have substantially the same properties, including heat resistance, and also improves the adhesion therebetween to an appropriate level.

In the first aspect, the second protective layer may have a lower softening point than the first protective layer and the glass substrate.

In the first aspect, the second protective layer is preferably positioned so as to overlap the heating element and not to overlap the electrode patterns. This provides a raised surface opposite the heating element and thereby creates a closer contact with a heating belt. If the second protective layer is positioned so as not to overlap the electrode patterns, the area of the second protective layer can be reduced relative to the area of the first protective layer. This effectively reduces warpage even though the second protective layer has a higher thermal expansion coefficient than the first protective layer and the glass substrate.

In the first aspect, the second protective layer preferably has a smaller volume than the first protective layer. If the second protective layer has a smaller volume than the first protective layer, the influence of the thermal expansion coefficient of the second protective layer can be reduced even though it has a higher thermal expansion coefficient than the first protective layer. This results in less warpage.

In the first aspect, the first filler contained in the first protective layer is preferably fused silica. Fused silica has a significantly low thermal expansion coefficient and, even in small amounts, will reduce the thermal expansion coefficient of the first protective layer.

In the first aspect, the volume fraction of the fused silica in the first protective layer is preferably 10% to 25%. This allows the thermal expansion coefficient of the first protective layer to be closer to that of the glass substrate while maintaining the fluidity of a paste-like mixture on the heating element and the electrode patterns.

In the first aspect, the fused silica preferably has a particle size of 0.4 to 1 μm. An insufficient particle size may decrease the fluidity of the paste, whereas an excessive particle size may decrease the surface smoothness. A particle size within the above range does not result in decreased fluidity or decreased surface smoothness.

In the first aspect, the electrode patterns preferably include positive and negative electrodes arranged alternately at a distance from each other on the glass substrate and wiring layers connected to the positive and negative electrodes. The heating element preferably extends across the glass substrate and the positive and negative electrodes. The wiring layers preferably extend from both sides of the heating element across the glass substrate.

DESCRIPTION OF THE PREFERRED EMBODIMENTS

Figure 1:
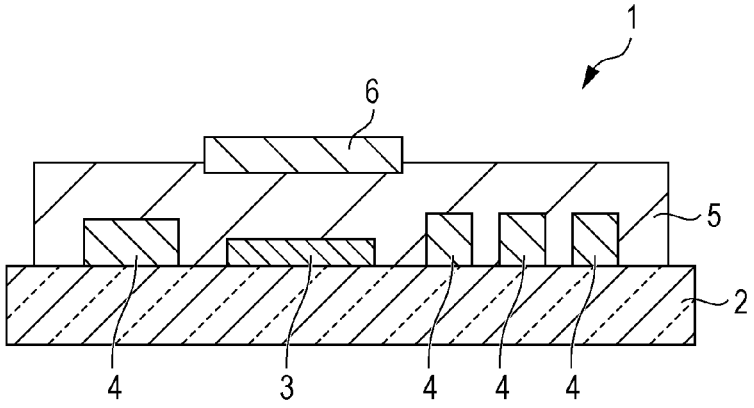
FIG. 1 is a partial cross-sectional view of a heater for fixing devices according to an embodiment of the present invention.
Figure 2:
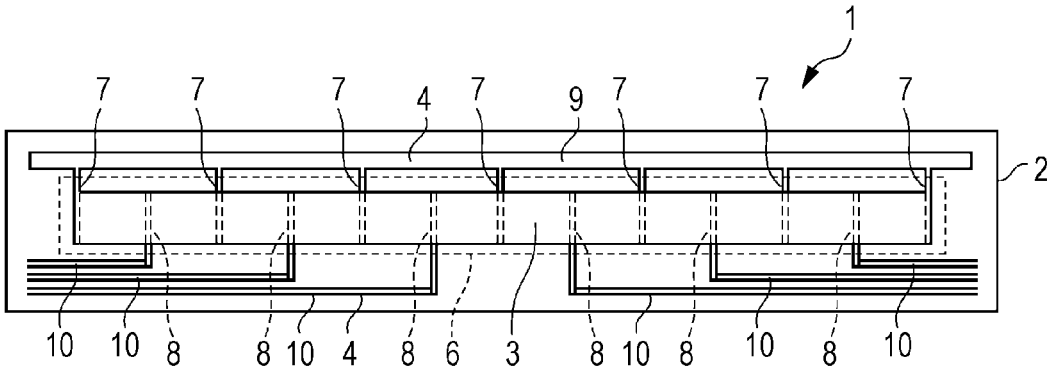
FIG. 2 is a plan view of the heater for fixing devices according to the embodiment.

FIG. 1 is a partial cross-sectional view of a heater for fixing devices according to an embodiment of the present invention. FIG. 2 is a plan view of the heater for fixing devices according to this embodiment.

As shown in FIG. 1, a heater 1 for fixing devices includes a glass substrate 2, a heating element 3 disposed on the glass substrate 2, a plurality of electrode patterns 4 disposed on the glass substrate 2 and connected to the heating element 3, a first protective layer 5 disposed on the heating element 3 and the electrode patterns 4, and a second protective layer 6 disposed on the first protective layer 5.

The glass substrate 2 is made of an alkali-free glass containing no alkali metal oxide. The alkali-free glass contains, for example, $SiO_2$ (about 60%), $Al_2O_3$ (about 15%), $B_2O_3$ (10%), MgO (several percent), and CaO (several percent).

The heating element 3 is formed by firing a paste containing a glass powder and $RuO_2$ (20%).

The electrode patterns 4 include common electrodes 7 and individual electrodes 8 disposed on the glass substrate 2. The common electrodes 7 and the individual electrodes 8 are arranged alternately at a distance from each other. The heating element 3 is disposed on and electrically connected to the electrodes 7 and 8.

The common electrodes 7 are connected to a wiring pattern 9 outside the heating element 3. The individual electrodes 8 are connected to wiring patterns 10 outside the heating element 3.

The wiring patterns 9 and 10 are disposed on the glass substrate 2.

One of the common electrodes 7 and the individual electrodes 8 is positive, whereas the other is negative.

The common electrodes 7 and the individual electrodes 8 are both formed by firing a gold (Au) resinate. The wiring patterns 9 and 10 are formed by firing a paste containing a glass powder and a silver powder (90% by volume).

The first protective layer 5 is formed by firing a mixture of a first glass powder and a first filler. The first glass powder contains no alkali metal oxide and has a lower softening point than the glass substrate 2. The first filler has a lower thermal expansion coefficient than the alkali-free glass for the glass substrate 2.

The first glass powder for the first protective layer 5 contains ZnO, $B_2O_3$, and $SiO_2$ or $Bi_2O_3$, $B_2O_3$, and $SiO_2$.

The first filler contained in the first protective layer 5 is preferably fused silica (quartz glass). Fused silica has a significantly low thermal expansion coefficient (i.e., 0.56 ppm/° C.) and, even in small amounts, will reduce the thermal expansion coefficient of the first protective layer 5.

The volume fraction of the fused silica in the first protective layer 5 is preferably 10% to 25%. This allows the thermal expansion coefficient of the first protective layer 5 to be closer to that of the glass substrate 2 while maintaining the fluidity of the paste.

The fused silica preferably has a particle size of about 0.4 to 1 μm. An insufficient particle size may decrease the fluidity of the paste, whereas an excessive particle size may decrease the surface smoothness. A particle size within the range of 0.4 to 1 μm does not result in decreased fluidity or decreased surface smoothness.

The first protective layer 5 has a thickness of about 20 to 50 μm.

The glass powder for the first protective layer 5 preferably contains a material, other than alkali metal oxides, that reduces the softening point of the first protective layer 5 below that of the glass substrate 2. An example of such a material is zinc oxide. This allows the softening point of the first protective layer 5 to be reduced to an appropriate level.

The second protective layer 6 is made of a material that does not contain the first filler contained in the first protective layer 5.

Preferably, the second protective layer 6 is formed by firing a second glass powder without adding the first filler. The second glass powder may contain zinc oxide as a material that reduces the softening point of the second protective layer 6 below that of the glass substrate 2. For example, a Teflon® coating on an overcoat glass layer, as disclosed in the cited literature, exhibits insufficient heat resistance if the heating element 3 heats up to about 300° C. In this embodiment, the use of glass for the second protective layer 6 improves the heat resistance of the second protective layer 6.

The first glass powder contained in the first protective layer 5 is preferably the same as the second glass powder contained in the second protective layer. This allows the first protective layer 5 and the second protective layer 6 to have substantially the same properties, including heat resistance, and also improves the adhesion therebetween to an appropriate level.

In this embodiment, the second protective layer 6 may contain an alkali metal oxide. For example, the second glass powder may contain an alkali metal oxide. This allows for a reduction in thermal expansion coefficient. The alkali metal oxide contained in the second protective layer 6 does not cause the problem of migration because the first protective layer 5 is disposed between the electrode patterns 4 and the second protective layer 6.

In this embodiment, the second protective layer 6 may contain a second filler that contains an alkali metal oxide, that has a lower thermal expansion coefficient than the second glass powder, and that softens at the surface thereof below the softening point of the glass substrate 2. For example, the second protective layer 6 contains eucryptite ($Li_2$—$Al_2O_3$—$SiO_2$) in an amount of about 20% by weight. This allows for a reduction in the thermal expansion coefficient of the second protective layer 6. Eucryptite melts slightly at the surface thereof during firing and thus does not decrease the surface smoothness. The alkali metal oxide contained in the second protective layer 6 does not cause the problem of migration because the first protective layer 5 is disposed between the electrode patterns 4 and the second protective layer 6. Examples of materials other than eucryptite include spodumene ($LiAlSi_2O_6$).

In this embodiment, the second protective layer 6 preferably has a lower softening point than the first protective layer 5 and the glass substrate 2.

The second protective layer 6 is preferably positioned so as to overlap the heating element 3 and not to overlap the electrode patterns 4 (wiring patterns 9 and 10) extending outside the heating element 3. This provides a raised surface opposite the heating element 3 and thereby creates a closer contact with a heating belt. If the second protective layer is positioned so as not to overlap the electrode patterns 4, the area of the second protective layer 6 can be reduced relative to the area of the first protective layer 5. This effectively reduces warpage even though the second protective layer 6 has a higher thermal expansion coefficient than the first protective layer 5 and the glass substrate 2.

In this embodiment, the second protective layer 6 preferably has a smaller volume than the first protective layer 5. If the second protective layer 6 has a smaller volume than the first protective layer 5, the influence of the thermal expansion coefficient of the second protective layer 6 can be reduced even though it has a higher thermal expansion coefficient than the first protective layer 5. This results in less warpage.

The second protective layer 6 has a thickness of about 5 to 10 μm.

According to this embodiment, neither of the glass substrate 2 and the first protective layer 5, which are in contact with the electrode patterns 4, contains an alkali metal oxide. Thus, the heater 1 according to this embodiment suffers from less migration than heaters in the related art.

Because the first glass powder contained in the first protective layer 5 has a lower softening point than the glass substrate 2, the first glass powder has a higher thermal expansion coefficient than the glass substrate 2. The first protective layer 5, however, further contains the first filler, which has a low thermal expansion coefficient and thus allows the thermal expansion coefficient of the first protective layer 5 to be closer to that of the glass substrate 2. This results in less warpage.

The first protective layer 5 tends to have large surface irregularities because it contains the first filler. The first protective layer 5, however, is covered with the second protective layer 6, which does not contain the first filler contained in the first protective layer 5 and thus has high surface smoothness.

EXAMPLES

Overcoat layers having a thickness of about 25 μm were formed over the entire surfaces of 100 mm square glass substrates. The amount of warpage and migration of each substrate were measured.

In the Example, an overcoat layer was formed using an alkali-free glass containing 20% fused silica (particle size=0.7 μm) as the first filler.

In the Comparative Example, an overcoat layer was formed using a glass containing 15% eucryptite (lithium-containing low-expansion filler) as the second filler.

An experiment was carried out in which the change in the resistance of a ruthenium resistor was measured at a heating temperature of 500° C. using gold and silver electrodes arranged at a distance of 0.5 mm from each other.

Figure 3:
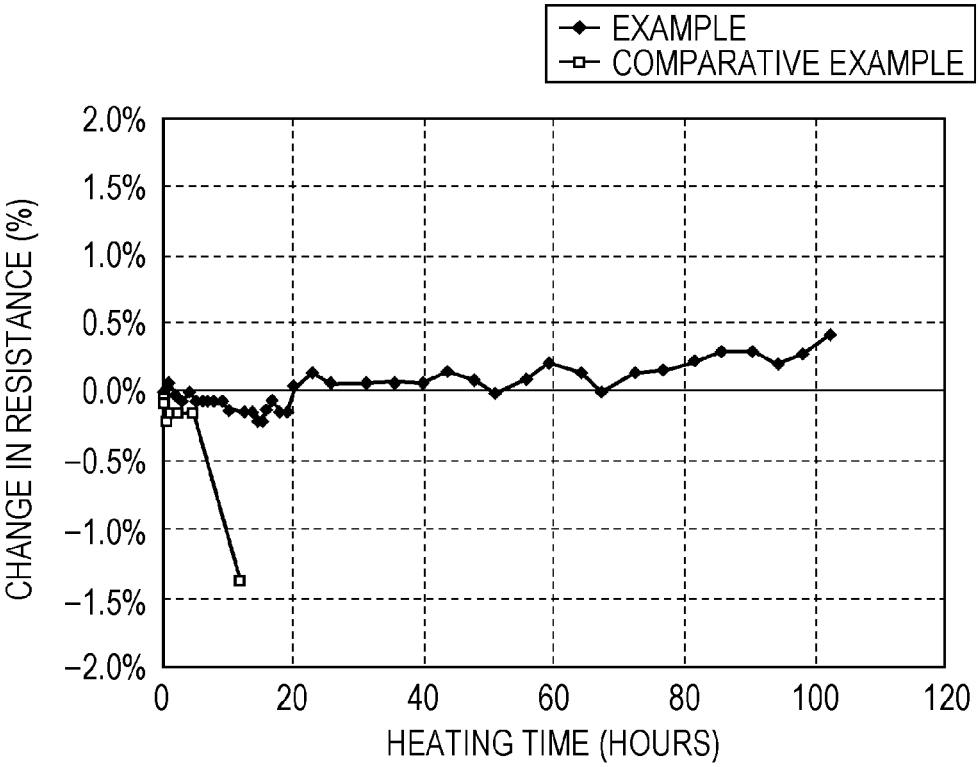
FIG. 3 shows experimental results of the Example and the Comparative Example for migration.

The experimental results are summarized in Table 1 below and FIG. 3.

TABLE 1

| Glass frit | Filler | Filler content | Thickness | Warpage | Migration resistance |
|---|---|---|---|---|---|
| ZnO-based | Eucryptite | 15 wt % | 25 μm | 0.3-0.4 mm | Poor |
| ZnO-based | Fused silica | 20 wt % | 25 μm | 0.03-0.06 mm | Good |

As shown in Table 1, more warpage occurred in the Comparative Example than in the Example.

Migration leads to a short circuit between electrodes and thus decreases the resistance therebetween. As shown in FIG. 3, the decrease in resistance in the Comparative Example demonstrates that migration occurred. In contrast, the small change in resistance in the Example demonstrates that little or no migration occurred.

What is claimed is:

1. A heater for a fixing device, comprising:

a glass substrate made of an alkali-free glass containing no alkali metal oxide, the glass substrate having a first softening point and a first thermal expansion coefficient;

a heating element disposed on the glass substrate;

a plurality of electrode patterns disposed on the glass substrate and connected to the heating element;

a first protective layer disposed on the heating element and the electrode patterns, the first protective layer being formed by firing a first mixture containing a first glass powder and a first filler, the first glass powder containing no alkali metal oxide and containing a material that reduces a softening point of the first protective layer to a second softening point lower than the first softening point, the first filler having a second thermal expansion coefficient smaller than the first thermal expansion coefficient; and a second protective layer disposed on the first protective layer, the second protective layer being made from a second mixture not containing the first filler.

2. The heater for a fixing device according to claim 1, wherein the second protective layer is formed by firing the second mixture containing a second glass powder without the first filler, the second glass powder containing a material that reduces a softening point of the second protective layer to a third softening point lower than the first softening point.

3. The heater for a fixing device according to claim 2, wherein the second protective layer contains an alkali metal oxide.

4. The heater for a fixing device according to claim 2, wherein the second mixture further contains a second filler that contains an alkali metal oxide, the second filler having a thermal expansion coefficient lower than a thermal expansion coefficient of the second glass powder, and a softening point lower than the first softening point.

5. The heater for a fixing device according to claim 4, wherein the second filler is eucryptite.

6. The heater for a fixing device according to claim 2, wherein the first glass powder and the second glass powder are made of a same glass powder material.

7. The heater for a fixing device according to claim 2, wherein the second protective layer has a third softening point lower than the first softening point and the second softening point.

8. The heater for a fixing device according to claim 1, wherein the second protective layer is disposed over the heating element so as not to overlap the electrode patterns.

9. The heater for a fixing device according to claim 1, wherein the second protective layer has a volume smaller than a volume of the first protective layer.

10. The heater for a fixing device according to claim 1, wherein the first filler is fused silica.

11. The heater for a fixing device according to claim 10, wherein a volume fraction of the fused silica in the first protective layer is 10% to 25%.

12. The heater for a fixing device according to claim 10, wherein the fused silica has a particle size of 0.4 to 1μm.

13. The heater for a fixing device according to claim 1, wherein the electrode patterns comprise:

positive and negative electrodes arranged alternately at a distance from each other on the glass substrate; and wiring layers connected to the positive and negative electrodes, and wherein the heating element extends across the glass substrate and the positive and negative electrodes, and the wiring layers extend from both sides of the heating element across the glass substrate.

14. The heater for a fixing device according to claim 1, wherein the material that reduces the softening point of the first protective layer includes zinc oxide.

15. The heater for a fixing device according to claim 2, wherein the material that reduces the softening point of the first protective layer includes zinc oxide.

* * * * *